US005078372A

United States Patent [19]

Fitzpatrick

[11] Patent Number: 5,078,372

[45] **Date of Patent: * Jan. 7, 1992**

[54] QUICK CHANGE VISE JAW

[76] Inventor: John P. Fitzpatrick, 17174 Buckingham, Birmingham, Mich. 48009

[ * ] Notice: The portion of the term of this patent subsequent to Oct. 2, 2007 has been disclaimed.

[21] Appl. No.: 589,063

[22] Filed: Sep. 27, 1990

Related U.S. Application Data

[63] Continuation of Ser. No. 420,584, Oct. 12, 1989, Pat. No. 4,960,270.

[51] Int. Cl.[5] ..... B25B 1/24

[52] U.S. Cl. ..... 269/282

[58] Field of Search ..... 269/279, 280, 282–284, 269/286, 246, 247, 285

[56] References Cited

U.S. PATENT DOCUMENTS 990,186 4/1911 Berg ..... 269/247

4,078,782 3/1978 Carlson ..... 269/283

4,750,722 6/1988 Chick ..... 269/282

4,861,010 8/1989 Neil ..... 269/282

*Primary Examiner*—Robert C. Watson

*Attorney, Agent, or Firm*—Dykema Gossett

[57] ABSTRACT

An improved vise jaw is disclosed that can be quickly mounted upon a standard vise to facilitate efficient assembly of a machining run. The vise jaw comprises a T-shaped slot at an attachment face for receiving a mounting bolt from the vise. An access opening extends forwardly to a clamping face allowing access of a tool for tightening the bolt within the T-shaped opening to secure the vise jaw to the vise. A chip shield is disclosed that extends between opposed vise jaws to cover a screw threaded member that moves the clamping plates with respect to each other. The chip shield prevents machining waste from reaching the screw threaded member and saves a large amount of time in required clean-up after machining operation.

6 Claims, 2 Drawing Sheets

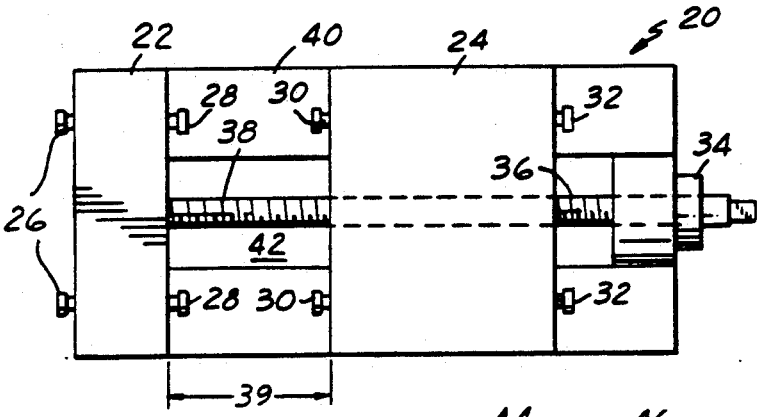
(PRIOR ART)
FIG. 1
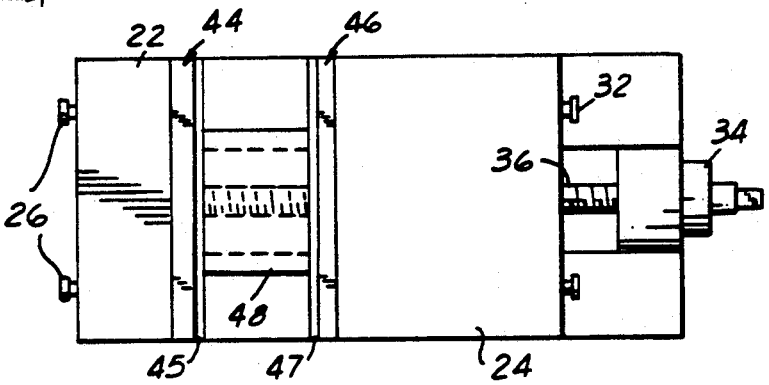
FIG. 2
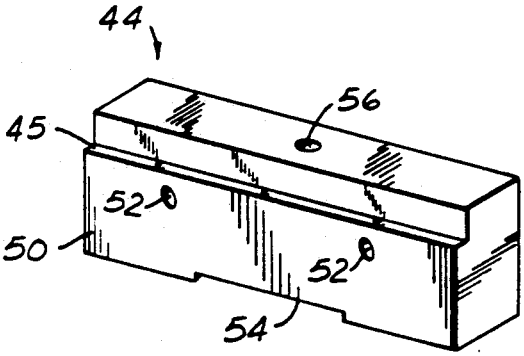
FIG. 3
FIG. 5
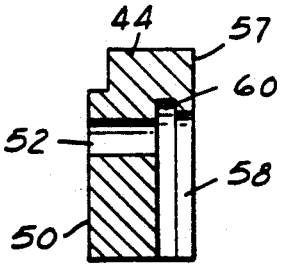
FIG. 4
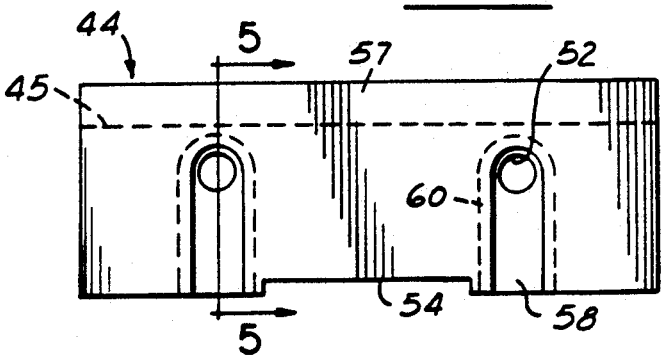

QUICK CHANGE VISE JAW

This is a continuation of copending application Ser. No. 07/420,584 filed on Oct. 12, 1989, now U.S. Pat. No. 4,960,270.

BACKGROUND OF THE INVENTION

This invention relates to a quick release vise jaw that embodies several unique features.

In modern machine shops, parts are typically machined by computer controlled tools in large runs or amounts. The set-up of these parts into the various vises that must hold the parts while being machined is still essentially a manually performed task. Among the steps that are required in assembling a vise for holding a part is the provision of a vise jaw on mounting bolts that are attached to the vise that actually grips the part. In some machining tasks, there may be dozens of vise jaws that must be mounted upon vises in order to set up the machining run. The manual mounting of the prior art vise jaws to the vises is a slow process that requires large amounts of labor and time to be expended.

Prior art quick release vise jaws have been developed that require reduced mounting time, however, in general they reduce the clamping surface area of the vise jaw. In some prior art vise jaws the quick release feature results in an opening at a clamping ledge that reduces clamping surface area. Also, these prior art vise jaws reduce the available clamping depth, which is the vertical extent of the clamping ledge that actually holds a part for machining. Reducing the clamping surface area may result in parts being improperly secured, misaligned or twisted.

It has been known to use T-shaped slots to mount a vise jaw to a bolt on a vise. However, these prior art vise jaws may not adequately secure the vise jaws to the vise, nor are they necessarily adaptable to modern vises.

An example of a type of vise that is most widely utilized in the modern machine tool industry is illustrated in Prior Art FIG. 1. As shown in FIG. 1, vise 20 comprises first plate 22 and second plate 24. A pair of outside bolts 26 and a pair of inside bolts 28 are fixed to first plate 22 and a pair of inside bolts 30 and a pair of outside bolts 32 are fixed to second plate 24. A moving mechanism 34, which includes threaded screw member 36 serves to adjust the distance between first plate 22 and second plate 24. Threaded screw member 36 has a variable exposed portion 38 between first plate 22 and second plate 24 which also defines a variable clamping distance 39. Exposed portion 38 is located below base surface 40 of vise 20, in ditch 42. Moving mechanism 34 adjusts the clamping distance 39 by moving second plate 24 towards and away from first plate 22.

With this type of prior art vise it is difficult to quickly and securely mount a vise jaw to the bolts on plates 22 and 24, and in addition, exposed portion 38 of threaded screw member 36 is exposed to machining wastes, such as chips, during machining operations. A burdensome clean-up is required when machining waste reaches exposed portion 38 of screw threaded member 36.

Thus, it is an object of the present invention to achieve a vise jaw arrangement that will be securely and quickly mounted to the bolts in a standard vise and at the same time will shield the threaded screw member from exposure to machining waste.

SUMMARY OF THE INVENTION

The present invention achieves a securely and quickly mounted vise jaw with the provision of a T-shaped slot extending from a first face of the vise jaw and having an access opening extending through to a second clamping face to allow a wrench or the like to access and tighten a bolt within the T-shaped slot. Due to the access opening, the bolts in the vise plates may be quickly tightened to securely hold the vise jaws. In addition, a slot is formed at a bottom face of the vise jaws and slidably receives a thin metal chip shield which protects the exposed portion of the threaded screw member.

In an embodiment of the present invention, a vise jaw has a clamping ledge on both faces such that clamping between the vise jaws may be performed at either the inside or the outside bolts on the vise plates.

In an embodiment of the present invention, a central adjustment assembly is included that allows a vise jaw to be utilized to accurately secure relatively small parts at a desired position. The central adjustment assembly may include an L-shaped member with a front portion received on a clamping ledge and having a longitudinally extending bore. An adjustment rod may be received in the bore and adjusted to define a stop at a selected longitudinal position corresponding to the particular small part.

In a further embodiment of the present invention, vise jaws are disclosed having concave curved portions to receive curved members for performing machining operations on the curved member. Alignment bores and bolts ensure the proper positioning of the chuck portions.

These and other objects and features of the present invention can be best understood from the following specification and appended drawings of which the following is a brief description.

BRIEF DESCRIPTION OF THE DRAWINGS

FIG. 1 is a top view of a prior art vise assembly.

FIG. 2 is a top view similar to FIG. 1, but showing the vise jaws as disclosed by the present invention.

FIG. 3 is a perspective view of a vise jaw as disclosed by the present invention.

FIG. 4 is a view of a rear face of a vise jaw as disclosed by the present invention.

FIG. 5 is a cross-sectional view along lines 5—5 as shown in FIG. 4.

DETAILED DESCRIPTION OF A PREFERRED EMBODIMENT

Figure 6:
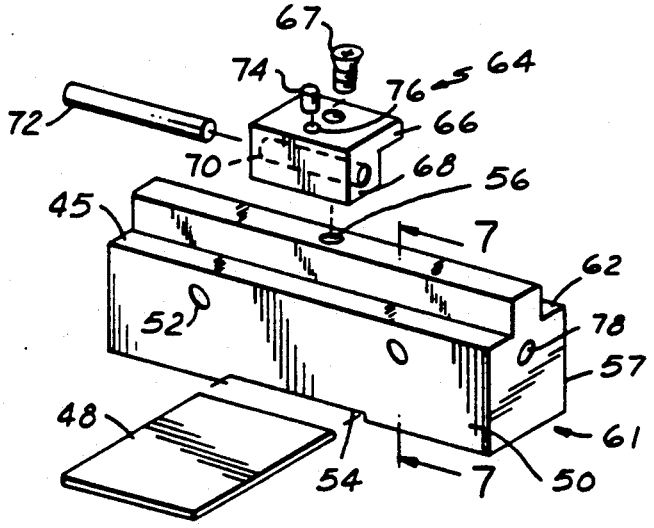
FIG. 6 is an exploded view of a second embodiment of a vise jaw as disclosed by the present invention.

As noted above, a prior art vise assembly 20 is shown in FIG. 1 consisting of a first plate 22 having outside bolts 26 and inside bolts 28, and a second plate having inside bolts 30 and outside bolts 32. A threaded screw member 36 has a variable exposed portion 38 in ditch 42 that is vertically below base surface 40 of the vise assembly 20.

The details of a first embodiment of the present invention will be disclosed with reference to FIGS. 2–5. As shown in FIG. 2, a generally rectangular vise jaw 44 having clamping ledge 45 is mounted to first plate 22 while second vise jaw 46 having clamping ledge 47 opposed to clamping ledge 45, is mounted to second plate 24. Chip shield 48 extends between vise jaws 44 and 46 and covers exposed portion 38. Moving mechanism 34 can be rotated to move second plate 24 along threaded screw member 36 and adjust the clamping distance 39 between vise jaws 44 and 46 for holding a particular part.

Vise jaws 44 and 46 are identical and thus only vise jaw 44 will be explained in detail. As shown in FIG. 3, vise jaw 44 has clamping ledge 45 defined by clamping face 50 which is of a lesser height than the overall height of vise jaw 44. The difference in height between clamping ledge 45 and the nominal height of vise jaw 45 is defined as a clamping depth. Access holes 52 extend through the width of vise jaw 44. Chip shield slot 54 is formed at a bottom face of vise jaw 44 and also extends throughout the width of vise jaw 44. Bolt hole 56 is formed at a top portion of vise jaw 44. Access holes 52 are at a height vertically below clamping ledge 45 thus providing a greater clamping surface area.

As shown in FIG. 4, an attachment face 57 is on the opposite side of vise jaw 44 from clamping face 50 and includes T-shaped openings 58, which are spaced by a longitudinal distance that corresponds to the longitudinal distance between the pairs of bolts 28, 30 on a standard prior art vise assembly 20. T-shaped openings 58 have enlarged portions 60 within the width of vise jaw 44 to receive the heads of bolts 28, 30. Access hole 52 extends into T-shaped opening 58 and allows access from clamping face 50 so that bolts 28, 30, can be accessed and tightened to secure vise jaws 44, 46 to first and second plates 22, 24. As can also be seen from FIG. 4, slot 54 extends through the width of vise jaw 44 from clamping face 50 to attachment face 57.

T-shaped opening 58 extends from the bottom face essentially parallel to the height, or vertical extent of vise jaw 44. A vertically uppermost portion of T-shaped opening 48 is semi-circular and centered about an axis extending through the center of access hole 52. Enlarged portion 60 follows the configuration of the rest of T-shaped opening 58. The semi-circular portion is designed to be at a vertical position corresponding to the height of bolts 28, 30 when vise jaw 44 rests on base surface 40. The head of each bolt 28, 30 is received in enlarged portion 60, at the semi-circular portion, and is centered upon the center axis of access hole 52. Access hole 52 has a diameter significantly smaller than enlarged portion 60, or the diameter of the bolt head, and is dimensioned to be only large enough that a tool, such as a hex wrench, can be inserted. Since access hole 52 is relatively small in diameter, it may be totally vertically below clamping ledge 45 allowing a larger clamping depth and increased clamping surface area. T-shaped opening 58 may also be flared outwardly at a bottom face to facilitate mounting upon a bolt.

FIG. 5 is a cross-sectional view of T-shaped opening 58 which illustrates enlarged portion 60 which is at the top of the T of T-shaped opening 58. Access hole 52 is shown extending from clamping face 50 to provide access to a bolt that will be received in T-shaped opening 58.

The operation of a vise 20 employing the improved vise jaw 44 of the present invention will be disclosed. Vise jaws 44 and 46 are mounted upon plates 22 and 24 by sliding T-shaped openings 58 upon a pair of bolts 28 or 30. A chip shield 48 is placed between the vise jaws 44, 46 and is aligned with slots 54 at some point prior to securing vise jaws 44, 46 to the bolts. Chip shield 48 can slide within slots 54 as second plate 24 moves towards and away from first plate 22 and is thin enough that it can be received between second plate 24 and base portion 40 of vise 20. Thus, chip shield 48 can extend beyond the attachment face 57 of vise jaw 46 should second plate 24 be moved towards first plate 22 to such an extent that chip shield 48 would have extended beyond slot 54 in vise jaw 46. A securing tool, such as a hex wrench, is now extended through access hole 52 to reach bolts 28 and 30 and tighten them within T-shaped openings 58 to secure vise jaws 44 and 46 to first plate 22 and second plate 24, respectively. The final vise assembly protects exposed portion 38 of threaded screw member 36 and additionally allows quick mounting of vise jaws 44, 46.

Figure 7:
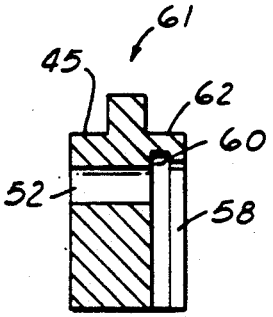
FIG. 7 is a cross-sectional view, similar to FIG. 5, but along lines 7—7 as shown in FIG. 6.
Figure 8:
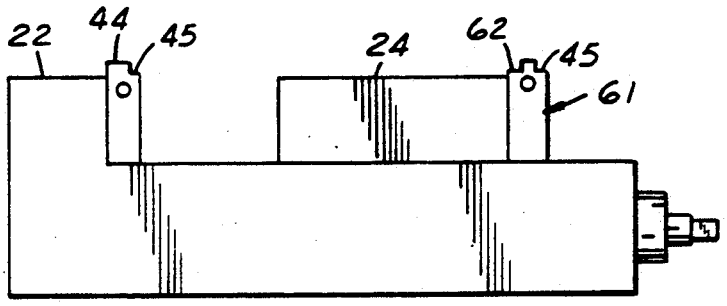
FIG. 8 is a side view of a vise assembly, such as shown in FIG. 1, but utilizing a vise jaw as disclosed in the second embodiment.

A second embodiment of the present invention will now be disclosed with reference to FIGS. 6–8. As shown in FIG. 6, a second embodiment of the vise jaw 61 has several features similar to the first embodiment of vise jaw 44 which are identified by the same reference numerals utilized in the first embodiment. Vise jaw 61 also has a second clamping ledge 62 formed on engagement face 57.

Central adjustment assembly 64, including L-shaped member 66, is attached by bolt 67 to bolt hole 56 in the top of vise jaw 61. Front portion 68 of L-shaped member 66 is received on clamping ledge 45, or alternatively clamping ledge 62, and includes bore 70 which receives an alignment rod 72, that may be adjusted within bore 70. Alignment rod 72 is longitudinally adjustable within bore 70 to define a stop at a selected position that will be determined by the size of a particular part that is to be clamped. Pin 74 may be inserted into pin hole 76 to lock alignment rod 72 at this selected position. Center adjustment assembly 64 allows the accurate placement and clamping of a part that has a longitudinal extend much smaller than the longitudinal extent of vise jaw 61. Side alignment hole 78 may also receive a bolt and a stop member to define an end stop of jaw clamp 61.

FIG. 7 is a cross-sectional view similar to FIG. 5 showing opposed clamping ledges 45 and 62. The second embodiment of vise jaw 61 is also known as a mirror image vise jaw and allows increased clamping flexibility as will be described below.

As shown in FIG. 8, the second embodiment of vise jaw 61 may be fixed to outside bolts 32 of second plate 24 with second clamping ledge 62 facing clamping ledge 45 of vise jaw 44. The height of clamping ledges 45 and 62 is above the height of second plate 24 so that a part may be clamped between vise jaws 44 and 61. With vise jaw 61, vise 20 may be utilized with parts requiring a relatively large clamping distance. With this arrangement, chip shield 48 could still be received to cover exposed portion 38 by placing it in slot 54 in vise jaw 44 and allowing second plate 24 to slide over the chip shield 48.

Figure 9:
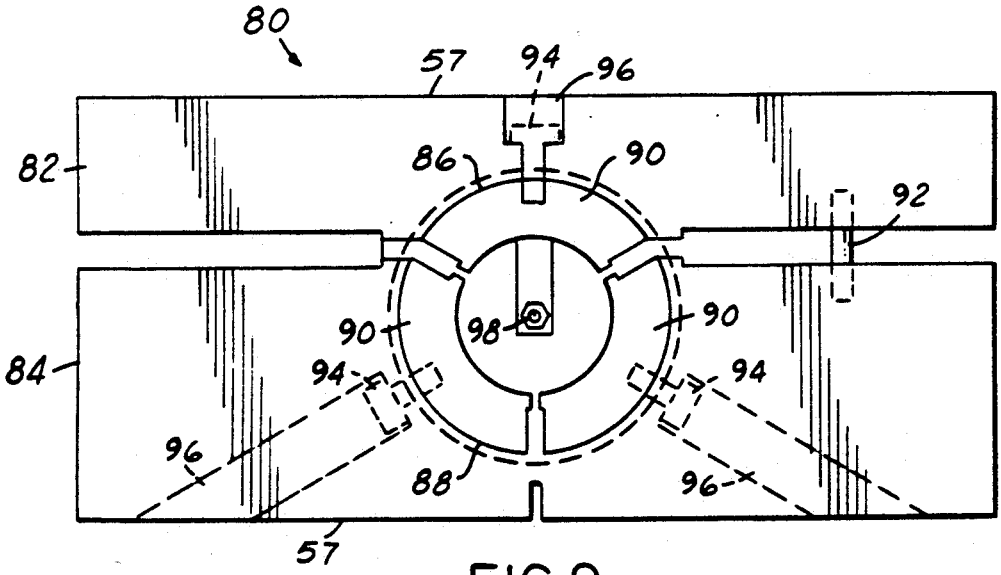
FIG. 9 is a top view of a third embodiment of the vise jaws of the present invention.

A third embodiment of the vise jaw 80 of the present invention is illustrated with reference to FIG. 9 and includes first vise jaw 82 and second opposed vise jaw 84. Vise jaw 82 includes concave curved portion 86 and vise jaw 84 includes concave curved portion 88. Concave curved portions 86, 88 are configured to hold a curved member 90. An alignment pin 92 ensures vise jaws 82 and 84 are aligned at a proper longitudinal position. Alignment bolts 94 extend through alignment bores 96 formed in the attachment faces 57 of vise jaws 82 and 84 to ensure proper circumferential alignment of curved member 90.

The vise jaws may be soft metal or they may be hardened. They may be manufactured in a variety of sizes to be useful in any clamping situation and with any standard vise. Chip shield may also be of various sizes.

A working embodiment of the present invention has been disclosed, however, a worker in the art would realize that several modifications would be within the scope of this invention and thus the following claims should be considered in order to determine the true scope and content of the present invention.

I claim:

1. A vise jaw comprising:

a generally rectangular member having a longitudinal extent, a height and a width, an attachment face being defined by said longitudinal extent and said height, said attachment face having a pair of openings spaced by a first longitudinal distance; and an access opening extending from each of said openings through said width and allowing access to said openings from a second face on an opposed side of said rectangular member from said attachment face, each of said access openings extending over a first area on said second face and each of said openings extending over a second area on said attachment face, said second area being greater than said first area.

2. A vise jaw as recited in claim 1, wherein said pair of openings having a generally T-shaped cross-section in a plane defined by said longitudinal extent and said width.

3. A vise comprising:

a base mounting a first plate, said first plate having a longitudinal extent and a pair of bolts for mounting a vise jaw, said pair of bolts being separated by a first longitudinal distance;

a second plate also being mounted upon said base and spaced from said first plate by a clamping distance, said second plate having a pair of bolts for mounting a vise jaw, said pair of bolts being separated by said first longitudinal distance;

means for moving said second plate towards and away from said first plate to adjust said clamping distance; and said vise jaws being generally rectangular and having a longitudinal extent, a height and a width, a first attachment face being defined by said longitudinal extent and said height, said attachment face having a pair of openings spaced by said first longitudinal distance, an access opening extending from each of said openings through said width and allowing access to said openings from a second face on an opposed side of said vise jaw from said attachment face, one of said pair of bolts being received within said openings in one of said vise jaws, each of said bolts having a head defining a surface area, each of said access openings extending over an area smaller than the surface area of said bolt heads.

4. A vise jaw as recited in claim 3, wherein said pair of openings have a generally T-shaped cross-section in a plane defined by said longitudinal extent and said width.

5. A vise comprising:

a base mounting a first plate, said first plate having a longitudinal extent and a pair of bolts for mounting a vise jaw, said pair of bolts being separated by a first longitudinal distance;

a second plate also being mounted upon said base and spaced from said first plate by a clamping distance, said second plate having a pair of bolts for mounting a vise jaw, said pair of bolts being separated by said first longitudinal distance;

means for moving said second plate towards and away from said first plate to adjust said clamping distance; and said vise jaws being generally rectangular and having a longitudinal extent, a height and a width, a first attachment face being defined by said longitudinal extent and said height, said attachment face having a pair of openings spaced by said first longitudinal distance, an access opening extending from each of said openings through said width and allowing access to said openings from a second face on an opposed side of said vise jaw from said attachment face, one of said pair of bolts being received within said openings in one of said vise jaws, a vertically uppermost portion of said bolts defining a first vertical position, a vertically uppermost portion of said access openings defining a second vertical position, said second vertical position being lower than said first vertical position.

6. A vise jaw as recited in claim 5, wherein said pair of openings have a generally T-shaped cross-section in a plane defined by said longitudinal extent and said width.

* * * * *